US009988223B2

(12) United States Patent
Hirata et al.

(10) Patent No.: US 9,988,223 B2
(45) Date of Patent: Jun. 5, 2018

(54) AUTOMATIC DOCUMENT FEEDING DEVICE

(71) Applicants: Munekazu Hirata, Kanagawa (JP); Takayuki Andoh, Kanagawa (JP); Koji Hatayama, Kanagawa (JP); Kaoru Tada, Kanagawa (JP); Tatsuaki Nagano, Kanagawa (JP); Yasunobu Youda, Kanagawa (JP); Toshiyuki Horikawa, Kanagawa (JP); Yohei Osanai, Kanagawa (JP); Kazushige Kawamura, Kanagawa (JP); Takuji Kawai, Kanagawa (JP)

(72) Inventors: Munekazu Hirata, Kanagawa (JP); Takayuki Andoh, Kanagawa (JP); Koji Hatayama, Kanagawa (JP); Kaoru Tada, Kanagawa (JP); Tatsuaki Nagano, Kanagawa (JP); Yasunobu Youda, Kanagawa (JP); Toshiyuki Horikawa, Kanagawa (JP); Yohei Osanai, Kanagawa (JP); Kazushige Kawamura, Kanagawa (JP); Takuji Kawai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/187,822

(22) Filed: Jun. 21, 2016

(65) Prior Publication Data

US 2016/0368728 A1 Dec. 22, 2016

(30) Foreign Application Priority Data

Jun. 22, 2015 (JP) ..... 2015-124657

(51) Int. Cl.
*B65H 1/04* (2006.01)
*B65H 31/02* (2006.01)
*B65H 43/08* (2006.01)

(52) U.S. Cl.
CPC ..... *B65H 1/04* (2013.01); *B65H 31/02* (2013.01); *B65H 43/08* (2013.01);
(Continued)

(58) Field of Classification Search
CPC ..... B65H 1/04; B65H 2405/3321; B65H 2405/324; B65H 2405/11162; B65H 2405/1117; B65H 2405/1134
See application file for complete search history.

(56) References Cited

U.S. PATENT DOCUMENTS 8,833,759 B2 * 9/2014 Fan Chiang ..... B65H 31/00 271/207
2015/0341515 A1 11/2015 Youda et al.

FOREIGN PATENT DOCUMENTS

JP 09086698 A * 3/1997
JP 2005347940 A * 12/2005
(Continued)

*Primary Examiner* — Luis A Gonzalez
(74) *Attorney, Agent, or Firm* — Harness Dickey & Pierce, P.L.C.

(57) ABSTRACT

An automatic document feeding device includes a document tray, an ejection tray, and a document takeout port. The document tray is rotatably attached to a rotation fulcrum provided in a body of the automatic document feeder, to load a document. The document tray includes a first positioner and a second positioner. The first positioner is disposed at a front side of the body in a direction perpendicular to a document feed direction. The second positioner is disposed at a depth side of the body in the direction perpendicular to the document feed direction. The first positioner is disposed upstream from the rotation fulcrum in the document feed direction and above the document takeout port in the body.
(Continued)

An upper portion and side surfaces of the first positioner in the direction perpendicular to the document feed direction are surrounded by the document tray in a closed state of the document tray.

7 Claims, 7 Drawing Sheets

(52) U.S. Cl.
CPC ..... *B65H 2301/4212* (2013.01); *B65H 2301/4213* (2013.01); *B65H 2402/31* (2013.01); *B65H 2402/5156* (2013.01); *B65H 2405/115* (2013.01); *B65H 2405/1117* (2013.01); *B65H 2405/1134* (2013.01); *B65H 2405/11162* (2013.01); *B65H 2405/121* (2013.01); *B65H 2405/324* (2013.01); *B65H 2405/3321* (2013.01); *B65H 2601/325* (2013.01); *B65H 2801/06* (2013.01); *B65H 2801/39* (2013.01)

(56) References Cited

FOREIGN PATENT DOCUMENTS

| | | | |
|---|---|---|---|
| JP | 2006-273535 | | 10/2006 |
| JP | 2007261761 A | * | 10/2007 |
| JP | 2008-195511 | | 8/2008 |
| JP | 2012-051733 | | 3/2012 |
| JP | 2015-035691 | | 2/2015 |

* cited by examiner

AUTOMATIC DOCUMENT FEEDING DEVICE

CROSS-REFERENCE TO RELATED APPLICATION

This patent application is based on and claims priority pursuant to 35 U.S.C, § 119(a) to Japanese Patent Application No. 2015-124657, filed on Jun. 22, 2015, in the Japan Patent Office, the entire disclosure of which is hereby incorporated by reference herein.

BACKGROUND

Technical Field

Aspects of the present disclosure relate to an automatic document feeding device including a rotatable document tray.

Related Art

In typical multifunction printers (MFPs), an image reading device is installed on a printer, and an automatic document feeder (hereinafter, also referred to as ADF) is further equipped on the image reading device. In the ADF, a document tray where documents are set and an ejection tray where the documents are ejected are disposed up and down for downsizing of the device body, and there is a possibility that an ejected document is left, especially, when the document has a small size. Therefore, a configuration to improve visibility by making a gap between the document tray and the ejection tray large at a front side of a device body is already known (hereinafter, the gap is referred to as a document takeout port).

SUMMARY

In an aspect of the present disclosure, there is provided an automatic document feeding device that includes a document tray, an ejection tray, and a document takeout port. The document tray is rotatably attached to a rotation fulcrum provided in a body of the automatic document feeder, to load a document. The ejection tray is disposed below the document tray, to stack the document automatically conveyed and ejected. The document having been ejected to the ejection tray is taken out through the document takeout port. The document tray includes a first positioner and a second positioner. The first positioner is disposed at a front side of the body in a direction perpendicular to a document feed direction. The second positioner is disposed at a depth side of the body in the direction perpendicular to the document feed direction. The first positioner is disposed upstream from the rotation fulcrum in the document feed direction and above the document takeout port in the body. An upper portion of the first positioner and side surfaces of the first positioner in the direction perpendicular to the document teed direction are surrounded by the document tray in a closed state of the document tray.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
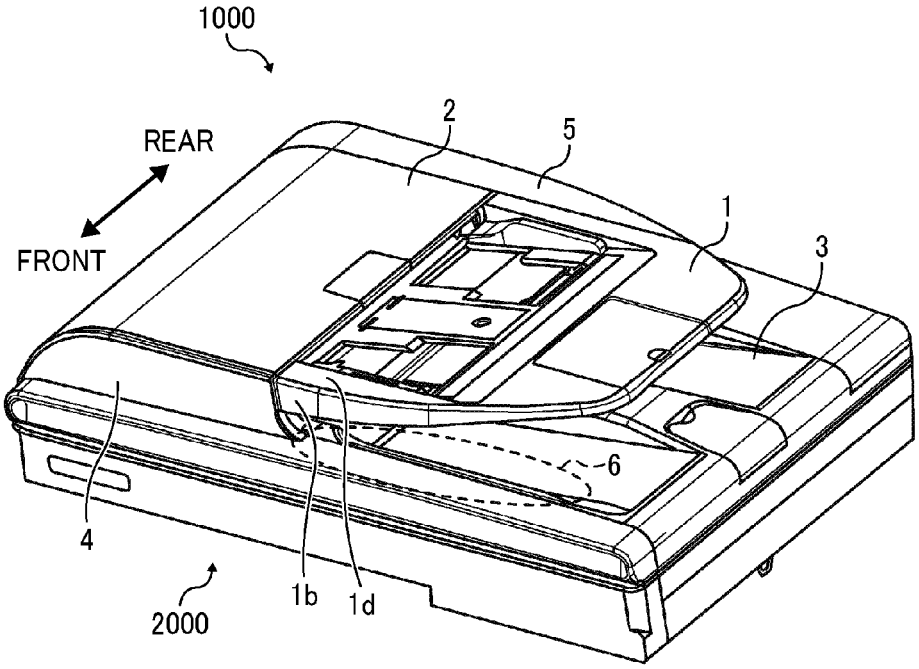
FIG. 1 is a perspective view of an automatic document feeding device according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology an selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments of the present disclosure will be described with reference to the drawings.

(First Embodiment)

Figure 2:
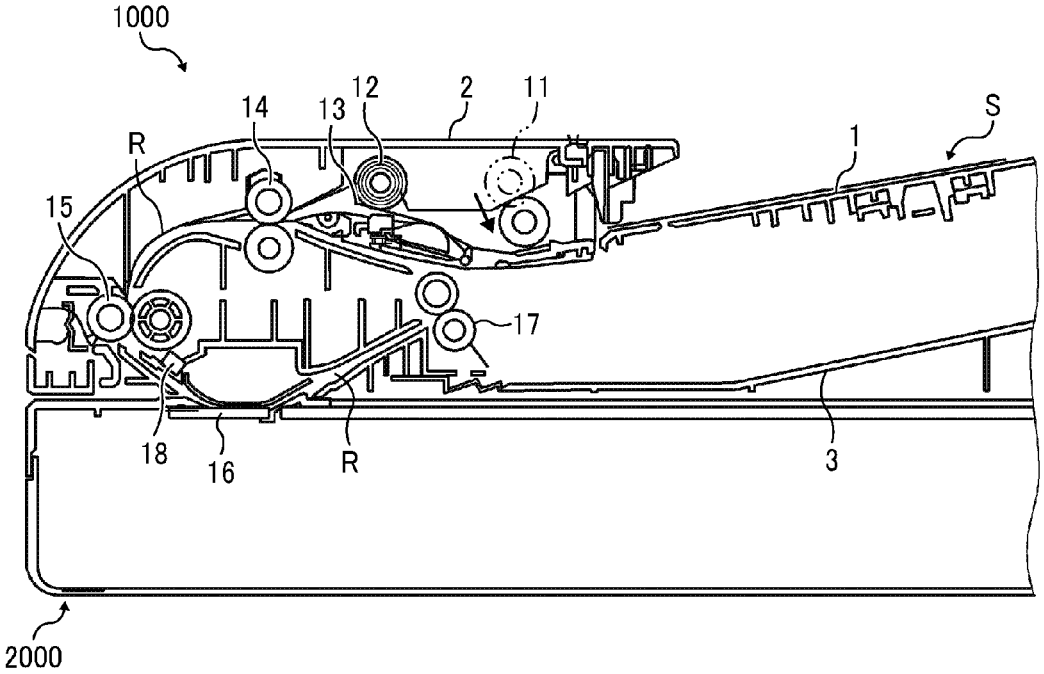
FIG. 2 is a cross-sectional view of the automatic document feeding device according to the first embodiment of the present disclosure.

FIG. 1 illustrates a perspective view of an automatic document feeding device 1000 according to this embodiment, and FIG. 2 is a cross-sectional view of the automatic document feeding device 1000.

As illustrated in FIG, 1, the automatic document feeding device 1000 includes a document tray 1, a cover 2, a front cover 4, a rear cover 5, an ejection tray 3, and a document takeout port 6, and is equipped on an upper surface of an image reading device 2000.

As illustrated in FIG. 2, a feed path R for conveying a document S from the document tray 1 to the ejection tray 3 is provided inside the automatic document feeding device 1000. A pickup roller 11, a feed roller 12, a separator 13, feed rollers 14 and 15, a reading portion 16, an ejection roller 17, and a registration sensor 18 are provided from an upstream side in a document feed direction along the feed path R in the automatic document feeding device 1000.

The document tray 1 is provided at aright-aide upper portion of the automatic document feeding device 1000 as viewed from the front of the device, and on which the document S to be conveyed is set and stacked. The cover 2 is provided at a left-side upper portion of the automatic document feeding device 1000 as viewed from the front of the device, and covers the inside and the feed path R of the automatic document feeding device 1000. The front cover 4 covers the inside and the feed path of the automatic document feeding device 1000 from the front side of the automatic document feeding device 1000, and the rear cover 5 covers the inside and the feed path R of the automatic document feeding device 1000 from the rear side.

The ejection tray 3 is disposed away from the document tray 1 below the document tray 1 by a predetermined distance. The document S conveyed on the feed path R is ejected to and stacked on the ejection tray 3. The ejection tray 3 and the document tray 1 are disposed up and down for downsizing of the automatic document feeding device. The document takeout port 6 exists in a gap between the document tray 1 and the ejection tray 3 at the front side of the automatic document feeding device 1000, and is in a place surrounded by the broken line illustrate in FIG. 1. A user takes out the document S ejected from the ejection tray 3 through the document takeout port 6. There is a possibility that the user leaves the document from a problem of visibility of the document in a case where the ejected document has a small size. Therefore, the automatic document feeding device 1000 has a configuration to secure the document takeout port 6 made of the gap between the document tray 1 and the ejection tray 3 large at the front side.

The pickup roller 11 takes in the documents S set on the document tray 1. When picking up the document S, the pickup roller 11 is moved downward, is brought into contact with an upper surface of a bundle of the documents S, and pulls in an uppermost document.

When a reading operation is terminated, the pickup roller 11 is moved upward, and is set to a standby state where the pickup roller 11 is separated from the bundle of the documents S by a predetermine distance. Accordingly, the user can set the documents.

The pickup roller 11 is held in a pickup holder, and swings up and down through a bidirectional torque limiter provided on an axis of the feed roller 12. The pickup roller 11 is lowered and brought into contact with the document surface when a motor is forwardly rotated, and rises and is stopped by coming in contact with the cover 2 when the motor is reversely rotated.

The feed roller 12 sends one sheet of document from the documents S taken in the pickup roller 11 toward the feed path R. The separator 13 separates the documents S conveyed to the feed roller 12 sheet by sheet.

The feed rollers 14 and 15 convey the document S separated at the separator 13 toward the reading portion 16. After an image of the document S is read in the reading portion 16 where reading timing is adjusted to a tip of the document by the registration sensor 18, the document S is ejected to the ejection tray 3 by the ejection roller 17. The reading portion 16 is made of an exposure glass, for example, and reads the image of the document S that passes through the feed path R above the reading portion 16.

Figure 3:
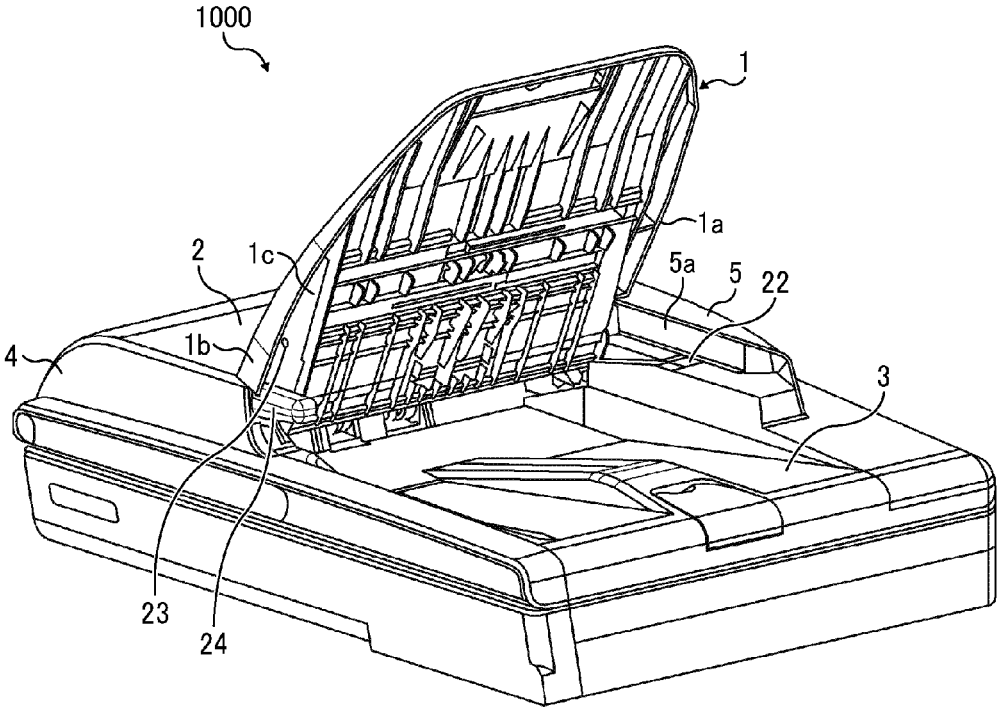
FIG. 3 is a perspective view of when a document tray of the automatic document feeding device according to the first embodiment of the present disclosure is opened.
Figure 4:
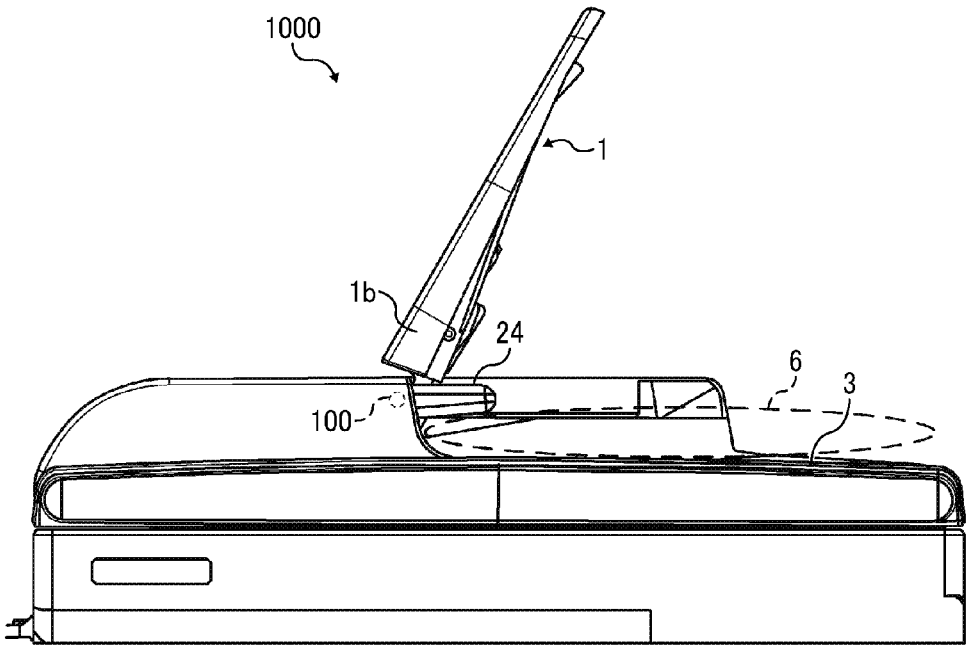
FIG. 4 is a front view of when the document tray of the automatic document feeding device according to the first embodiment of the present disclosure is opened.

FIG. 3 illustrates a perspective view of when the document tray 1 of the automatic document feeding device 1000 according to this embodiment is opened, and FIG. 4 is a front view.

As illustrated in FIG. 4, the document tray 1 is attached to the rotation fulcrum 100 provided in a body of the automatic document feeding device 1000, and has a configuration to be rotated upward using the rotation fulcrum 100 as an axis for allowing the user to easily take out the ejected document S. A first positioner 24 provided in the body of the automatic document feeding device 1000, and an engaged portion 23 engaged with the first positioner 24 in a manner that is mounted on the first positioner 24 are provided in the document tray 1. Further, as illustrated in FIG. 3, positioners of rotation of the document tray 1 are provided at both ends in a direction perpendicular to a document feed direction near the center of the body of the automatic document feeding device 1000. It is the first positioner 24 provided at the front side and it is a second positioner 22 provided at a depth side.

Note that a state in which the document tray 1 is open as illustrate in FIGS. 3 and 4 is referred to as an open state, an a state in which the document tray 1 is closed as illustrated in FIGS. 1 and 2 is referred to as a closed state.

The second positioner 22 and the first positioner 24 are engaged with the engaged portion 23 provided in the document tray 1 in the state of FIG. 1, and support the document tray 1 in the position illustrated in FIG. 1. Here, the first positioner 24 is arranged at an upstream side in the document feed direction with respect to the rotation fulcrum 100 and above the document takeout port 6 in the body of the automatic document feeding device 1000.

The automatic document feeding device 1000 has the first positioner 24 arranged above the document takeout port 6, thereby to secure the visibility of the document, and thus can prevent the document from being left. Further, the first positioner 24 of the document tray 1 is disposed at an upstream side in the document feed direction, Therefore, damage or deformation of the document tray 1 due to application of a large load to the document tray 1 when a large amount of documents is stacked on the document tray 1 can be prevented, and thus sheet feeding failure can be prevented.

Figure 5:
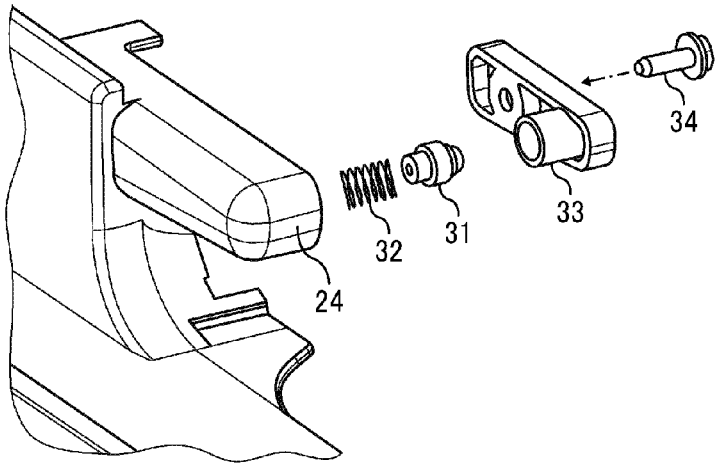
FIG. 5 is an exploded view of a first positioner of the automatic document feeding device according to the first embodiment of the present disclosure.
Figure 6:
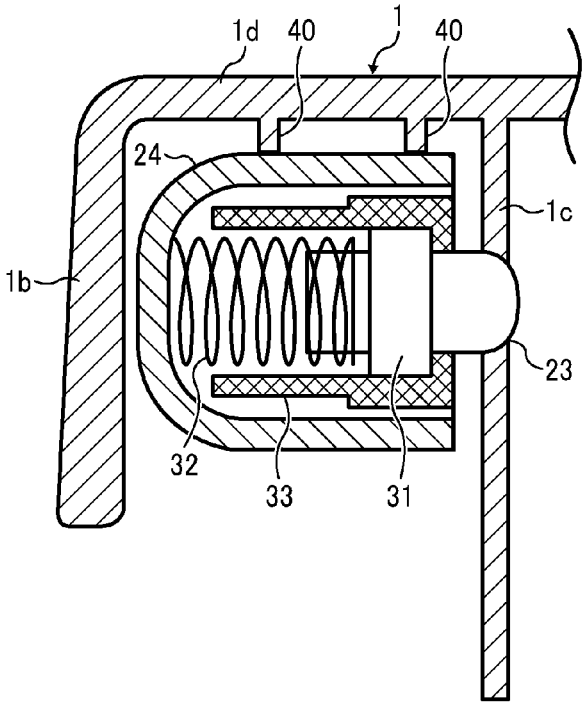
FIG. 6 is a cross-sectional view of the first positioner of the automatic document feeding device according to the first embodiment of the present disclosure.

FIG. 5 is a diagram for describing an exploded state of the first positioner 24, and FIG. 6 is a cross-sectional view of the first positioner 24 in a direction perpendicular to the document feed direction, The first positioner 24 includes a biasing member 32, an engaging portion 31, a cover member 33, and a screw 34. The engaging portion 31 is engaged with the engaged portion 23 disposed in the document tray 1, thereby to hold the document tray 1. When the document tray 1 is held, the document tray 1 can be prevented from flapping when the automatic document feeding device 1000 is opened/closed. Therefore, damage of the document tray 1 or occurrence of noises can be prevented. The engaging portion 31 and the biasing member 32 configure a holder according to the present embodiment.

The engaging portion 31 is provided near a tip of the first positioner 24 at an upstream side in the document feed direction. Here, the distance from the rotation fulcrum 100 to the engaging portion 31 needs to achieve both of suppression of bending caused in the document tray 1 and securing of the visibility of the document. Description will be given below.

A load moment by the document tray 1 on which the documents are stacked acts on the engaging portion 31 because the engaging portion 31 is engaged with the engaged portion 23. If the distance between the engaging portion 31 and the rotation fulcrum 100 is short, the document tray 1 is easily bent due to the load of the documents. Meanwhile, if the first positioner 24 is simply made long, and the distance between the engaging portion 31 and the rotation fulcrum 100 is made long, the document ejected on the ejection tray 3 is hard to see from a side, and the visibility cannot be secured.

The distance between the engaging portion 31 and the rotation fulcrum 100 in the automatic document feeding device 1000 according to this embodiment is about 50 to 100 mm, for example, and is longer than conventional products. Therefore, the distance can suppress the bending of the document tray 1, and can secure the visibility of the document.

Here, as illustrated in FIG. 6, the document tray 1 performs positioning by allowing projections 40 disposed on the document tray 1 to be in contact with the first positioner 24. However, the positioning may be performed with the engaging portion 31 and the engaged portion 23 without disposing the projections 40 on the document tray 1. Because the document tray 1 includes the projections 40 as a configuration of the positioning in the direction of rotation, the load is supported when the documents S are loaded on the document tray 1. Therefore, the deformation of the document tray 1 can be prevented, and sheet feeding is stabilized.

Further, at the time of the closed state of the document tray 1, an upper portion of the first positioner 24 is covered with and surrounded by an upper surface 1*d* of the document tray 1, and side surfaces of the first positioner 24 in a lateral width direction of document are respectively covered with and surrounded by a front-side side surface 1*b* and a depth-side side surface 1*c* of the document tray 1. As illustrated in FIG. 6, the first positioner 24 is butted against the front-side side surface lb in the lateral width direction of the document S. Accordingly, an inclination of the document tray 1 is eliminated, and skew can be prevented.

The engaging portion 31 is biased in a direction perpendicular to the document feed direction by the biasing member 32 disposed in the body of the first positioner 24, Accordingly, an operation to fix the document tray 1 with a screw or the like is not required in an opening/closing operation of the document tray 1, and thus operability of the opening/closing operation is improved. The biasing member 32 is made of an elastic body such as a spring. The engaging portion 31 is covered with the cover member 33, and the cover member 33 is fixed with the screw 34. However, the cover member 33 and the front cover 4 may be engaged by snap-fit without using the screw 34.

Further, the document tray 1 is biased by the engaging portion 31 of the first positioner 24, and a contact portion 1*a* (see FIG. 3) provided on a side surface at a depth side of the document tray 1 is butted against a contacted portion 5*a* provided in the rear cover 5 at the depth side of the body of the automatic document feeding device 1000, Accordingly, no backlash is given to the document tray 1 in a direction perpendicular to the document feed direction. Therefore, the skew or positional deviation in a main scanning direction at the time of reading an image can be prevented.

As described above, in the automatic document feeding device 1000 according to this embodiment including the document tray 1 rotatable with respect to the rotation fulcrum 100, the ejection tray 3, and the document takeout port 6 for allowing the user to take out the document S ejected from the ejection tray 3, the document tray 1 includes the first positioner 24 provided at the front side of the body of the automatic document feeding device 1000 and the second positioner 22 provided at the depth side, in the direction perpendicular to the document feed direction, the first positioner 24 is arranged at the upstream side in the document feed direction with respect to the rotation fulcrum 100 and above the document takeout port 6 in the body of the automatic document feeding device 1000, and the upper portion and the side surfaces in the direction perpendicular to the document feed direction, of the first positioner 24, are surrounded by the document tray 1 in the closed state of the document tray 1.

With this configuration, the first positioner 24 is arranged above the document takeout port 6. Therefore, the visibility of the document S ejected on the ejection tray 3 can be secured, and the user can be prevented from leaving the document. Further, the first positioner 24 is disposed at the upstream side in the document feed direction. Therefore, the damage or deformation of the document tray 1 due to application of a large load to the document tray 1 when a large amount of documents is stacked on the document tray 1 can be prevented, and the sheet feeding failure can be prevented.

Further, the upper portion and the side surfaces in the direction perpendicular to the document feed direction, of the first positioner 24, may be surrounded by the document tray 1 in the closed state of the document tray 1, With this configuration, an inclination of the document tray 1 is eliminated, and thus the skew can be prevented.

Further, the first positioner 24 or the second positioner 22 may include a document tray holder that holds the document tray 1. With this configuration, the first positioner 24 or the second positioner 22 holds the document tray 1 with the document tray holder, thereby to prevent the document tray 1 from flapping at the time of opening/closing the document tray 1. Therefore, the damage of the document tray 1 or occurrence of noises can be prevented.

Further, the document tray holder included in the first positioner 24 or the second positioner 22 may include the engaging portion 31 engaged with the engaged portion 23 disposed in the document tray 1 and the biasing member 32 that biases the engaging portion 31. With this configuration, the engaging portion 31 is biased. Therefore, operability of a rotation operation of the document tray 1 can be improved.

Further, a biasing direction of the biasing member 32 is the direction perpendicular to the document feed direction, Further, as illustrated in FIG, 3, the body of the automatic document feeding device 1000 may include the contact portion 1*a* at a position where biasing force by the biasing member 32 is received, and the rear cover 5 of the document tray 1 may include the contacted portion 5*a* that is contacted by the contact portion 1*a*. With this configuration, the backlash in the direction perpendicular to the document feed direction of the document tray 1 is reduced, whereby the inclination of the document tray 1 can be decreased, and the skew can be decreased.

(Second Embodiment)

Next, a second embodiment of the present disclosure will be described with reference to FIGS. 7 to 10.

This embodiment is different from the first embodiment in that a document tray 1 includes a plurality of engaged portions. However, other configurations are basically similar. Therefore, the same component will be described using the same reference code as the first embodiment illustrated in FIGS. 1 to 6, and only the different point will be especially described in detail.

Figure 7:
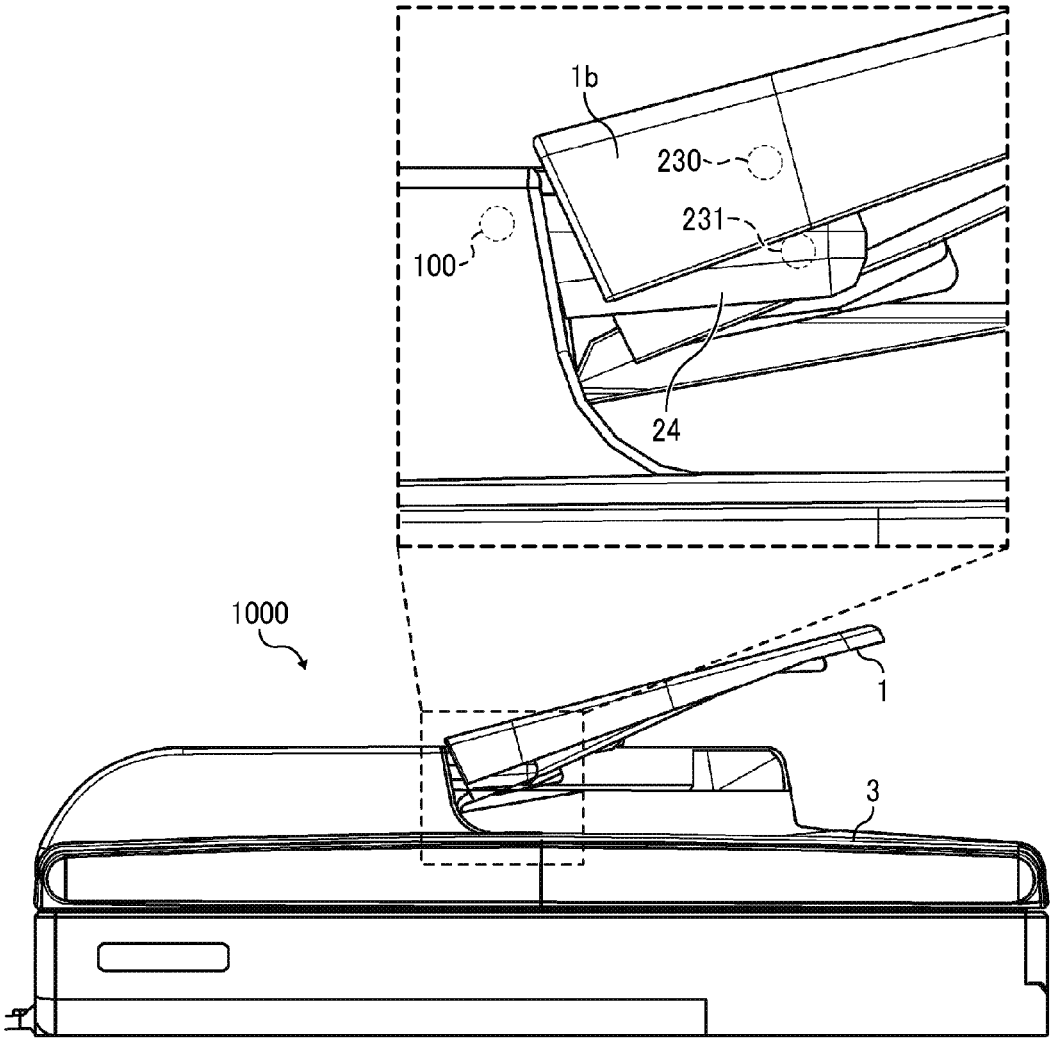
FIG. 7 is an enlarged view of a first positioner of an automatic document feeding device according to a second embodiment of the present disclosure.
Figure 8:
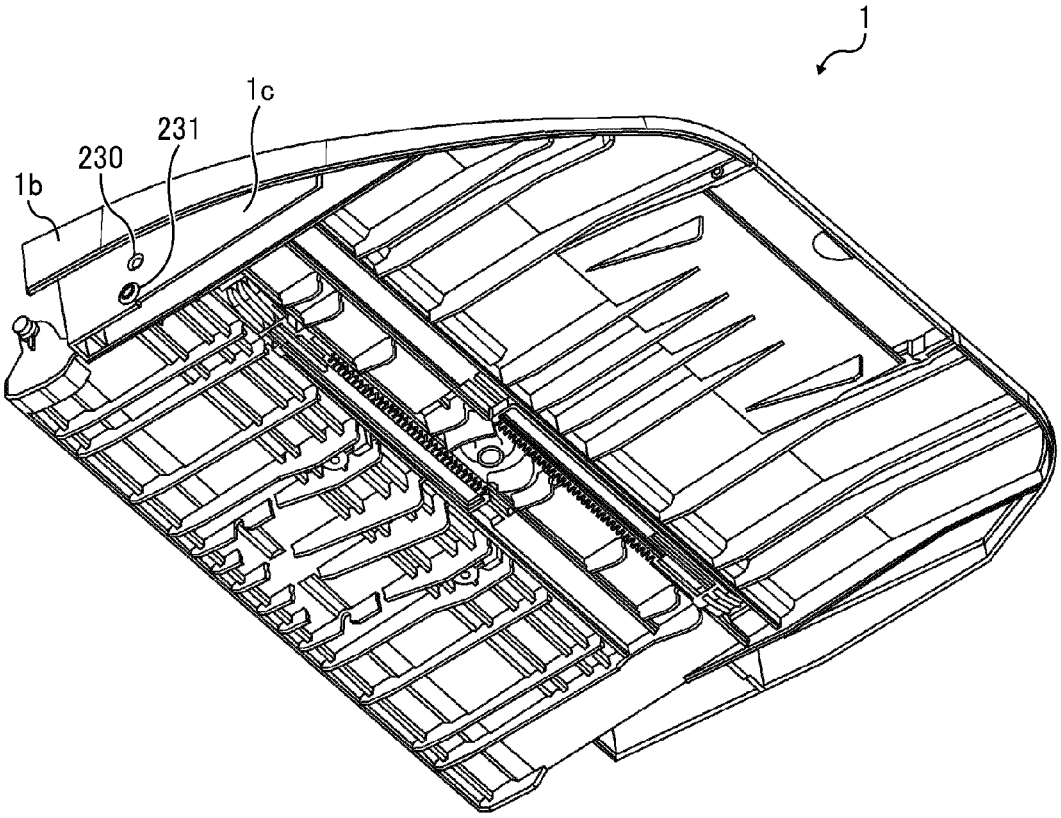
FIG. 8 is a perspective view of the first positioner of the automatic document feeding device according to the second embodiment of the present disclosure.

FIG. 7 is an enlarged view of a first positioner 24 in this embodiment, and FIG. 8 is a perspective view of the document tray 1.

As illustrated in FIGS. 7 and 8, the document tray 1 includes a first engaged portion 230 positioned in a closed state that is a posture of the document tray 1 when a reading operation is performed, and a second engaged portion 231 positioned in an open state that is a posture of the document tray 1 when a document ejected to an ejection tray 3 is taken out. The first engaged portion 230 and the second engaged portion 231 are engaged with an engaging portion 31 provided in the first positioner 24 at respective predetermined positions and are positioned. With this configuration, the plurality of engaged portions is included. Therefore, a user does not need to press the document tray 1 with a hand when taking out the document. Therefore, operability can be improved.

Figure 9:
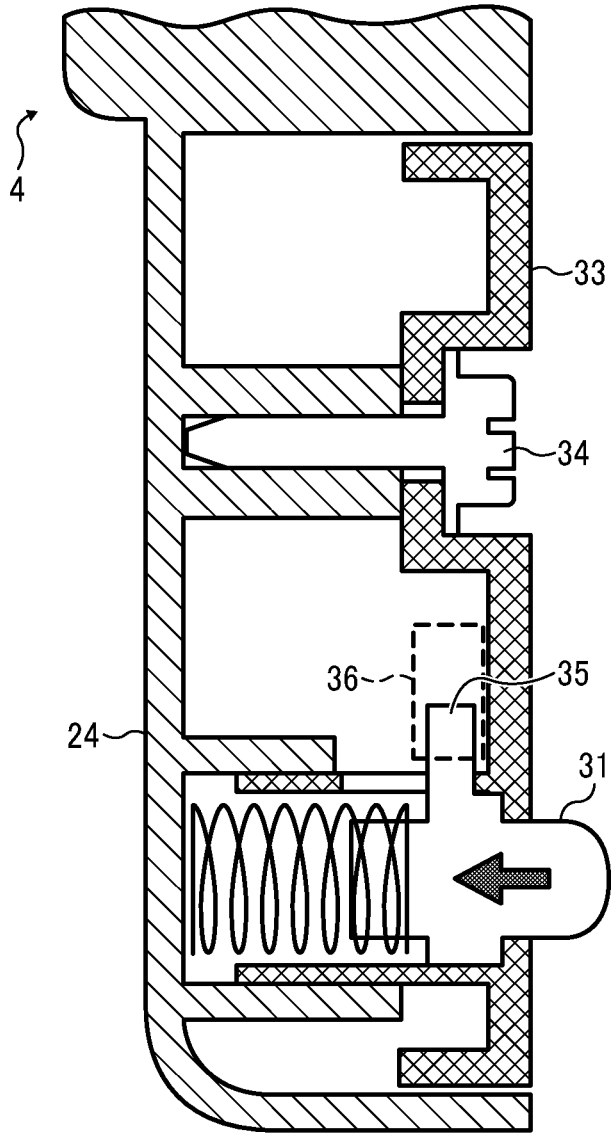
FIG. 9 is a cross-sectional view of the first positioner of the automatic document feeding device according to the second embodiment of the present disclosure.

FIG. 9 is a cross-sectional view of the first positioner 24 in a document feed direction. As illustrated in FIG. 9, the first positioner 24 includes a document-tray opening-closing detector 36, an operative portion 35, the engaging portion 31, a screw 34, and a cover member 33. The operative portion 35 is included in the engaging portion 31, and is engaged with the first engaged portion 230 or the second engaged portion 231 included in the document tray 1. The document-tray opening-closing detector 36 is made of a photo-interrupter, and the operative portion 35 is made of a light shield rib. The engaging portion 31 is covered with the cover member 33, and the cover member 33 is fixed with the screw 34. However, the cover member 33 and a front cover 4 may be engaged by snap-fit without using the screw 34.

The operative portion 35 shields light to the document-tray opening-closing detector 36 when the engaging portion 31 is engaged with the first engaged portion 230 and the document tray 1 is in the closed state, so that the document-tray opening-closing detector 36 detects the open state and the closed state of the document tray 1, The document-tray opening-closing detector 36 detects the closed state of the document tray 1, that is, a document conveyable state, thereby to detect that the document is left and notify the user, when the document such as a small-sized sheet is ejected, the sheet being able to be taken out only after the document tray 1 is opened.

Further, the operative portion 35 is included in the engaging portion 31, and thus it is not necessary to separately provide the operative portion 35 in an automatic document feeding device 1000. Therefore, the number of components is not increased more than necessary, and the cost can be reduced.

Figure 10:
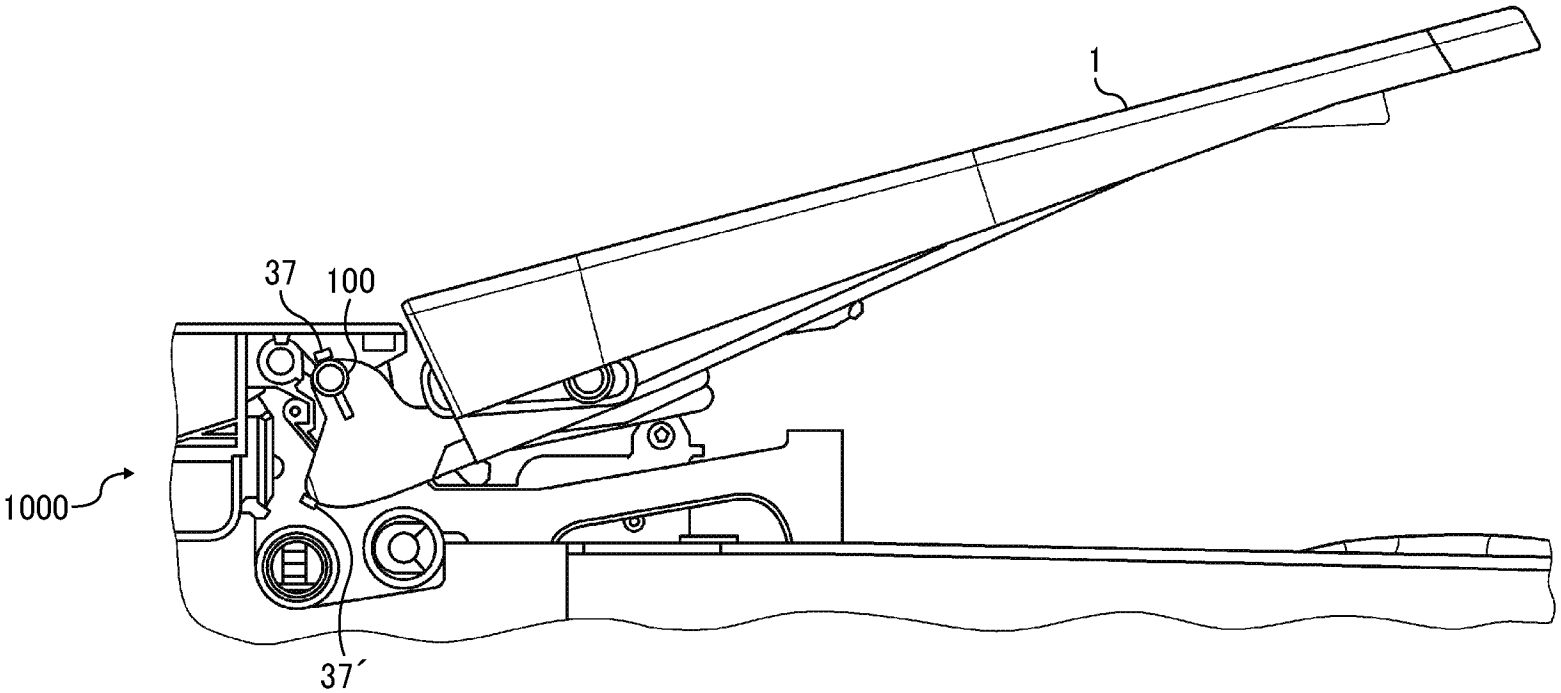
FIG. 10 is a diagram illustrating a rotation stopper of the automatic document feeding device according to the second embodiment of the present disclosure.

FIG. 10 is a diagram illustrating a rotation stopper of the automatic document feeding device. As illustrated in FIG. 10, the document tray 1 may include a rotation stopper 37 so that the document tray 1 can be rotated only from the state where the first engaged portion 230 is engaged to the state where the second engaged portion 231 is engaged. The rotation stopper 37 is provided in a vicinity of a rotation fulcrum 100 of the document tray 1, and is provided to be butted against the front cover 4 or a side plate of the cover 2 when the document tray 1 is rotated to a predetermined state. Note that the rotation stopper may be provided in a rotating portion other than the vicinity of the rotation fulcrum 100, in the document tray 1, and may be provided near the reference code 37' in FIG. 10.

Further, the document-tray opening-closing detector 36 is made of a photo-interrupter, and the operative portion 35 is made of a light shield rib. However, the document-tray opening-closing detector 36 and the operative portion 35 may he made of a switch and a switch pressing portion.

As described above, the document tray 1 of the automatic document feeding device 1000 according to this embodiment includes the first engaged portion 230 and the second engaged portion 231, which are a plurality of engaged portions. With this configuration, the document tray 1 includes the plurality of engaged portions and thus can be fixed in a state where the document tray 1 is opened. Therefore, operability of when the user takes out a document S ejected from the ejection tray 3 can be improved.

Further, the document tray 1 may include the document-tray opening-closing detector 36 that detects opening and closing operations of the document tray 1. With this configuration, in a case where the ejected document can be taken out only after the document tray 1 is opened, the document-tray opening-closing detector 36 detects opening/closing of the document tray 1, thereby to prevent the user from leaving the document.

Further, the document-tray opening-closing detector 36 may detect opening/closing of the document tray 1 when the engaging portion 31 acts on the document-tray opening-closing detector 36. With this configuration, the number of components of the automatic document feeding device 1000 can be decreased, and thus the cost can be reduced.

As described above, the embodiments of the present disclosure have been described. However, the present disclosure is not limited to the above-described embodiments, and various changes can be added without departing from the spirit of the present disclosure, According to at least one embodiment of the present disclosure, the damage or deformation is prevented while the visibility of the document in the document takeout port is secured, whereby conveyance failure of the document can be prevented. The embodiments of the present disclosure are useful for various automatic document feeding devices.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An automatic document feeding device comprising:

a document tray rotatably attached to a rotation fulcrum provided in a body of the automatic document feeder, to load a document;

an ejection tray disposed below the document tray, to stack the document automatically conveyed and ejected;

a document takeout port through which the document having been ejected to the ejection tray is taken out;

a first positioner disposed at a front side of the body in a direction perpendicular to a document feed direction; and a second positioner disposed at a depth side of the body in the direction perpendicular to the document feed direction, wherein the first positioner is disposed upstream from the rotation fulcrum in the document feed direction and above the document takeout port in the body, wherein an upper portion of the first positioner and side surfaces of the first positioner in the direction perpendicular to the document feed direction are surrounded by the document tray in a closed state of the document tray, wherein the first positioner or the second positioner includes a document tray holder having a biasing member, wherein a biasing direction of the biasing member is the direction perpendicular to the document feed direction, wherein the document tray includes a contact portion at a position where the body receives a biasing force from the biasing member, and wherein the body includes a contacted portion to be contacted by the contact portion.

2. An automatic document feeding device comprising:

a document tray rotatably attached to a rotation fulcrum provided in a body of the automatic document feeder, to load a document;

an ejection tray disposed below the document tray, to stack the document automatically conveyed and ejected;

a document takeout port through which the document having been ejected to the ejection tray is taken out;

a first positioner fixed to a front side of the body in a direction perpendicular to a document feed direction; and a second positioner fixed to a depth side of the body in the direction perpendicular to the document feed direction, wherein the first positioner is disposed upstream from the rotation fulcrum in the document feed direction and above the document takeout port in the body, wherein an upper portion of the first positioner and side surfaces of the first positioner in the direction perpendicular to the document feed direction are not surrounded by the document tray in an open state of the document tray, wherein the first positioner or the second positioner includes a document tray holder to hold the document tray, and wherein the document tray includes a document-tray opening-closing detector to detect opening and closing operations of the document tray.

3. The automatic document feeding device according to claim 2, wherein the document tray holder includes:

an engaging portion to engage an engaged portion of the document tray; and a biasing member to bias the engaging portion.

4. The automatic document feeding device according to claim 3, wherein a biasing direction of the biasing member is the direction perpendicular to the document feed direction, wherein the document tray includes a contact portion at a position where the body receives a biasing force from the biasing member, and wherein the body includes a contacted portion to be contacted by the contact portion.

5. The automatic document feeding device according to claim 3, wherein the document tray includes a plurality of the engaged portions.

6. The automatic document feeding device according to claim 1, wherein the document tray includes a document-tray opening-closing detector to detect opening and closing operations of the document tray.

7. The automatic document feeding device according to claim 6, wherein the document tray holder includes an engaging portion to engage an engaged portion of the document tray, and wherein the document-tray opening-closing detector detects opening and closing of the document tray by an action of the engaging portion on the document-tray opening-closing detector.

* * * * *